US007121037B2

(12) United States Patent
Penney

(10) Patent No.: US 7,121,037 B2
(45) Date of Patent: Oct. 17, 2006

(54) EXTERNAL ADJUSTABLE TELESCOPIC SCOPE DEVICE

(76) Inventor: Robert Nils Penney, 66 Philchriss Dr., Dover, DE (US) 19901

( * ) Notice: Subject to any disclaimer, the term of this patent is extended or adjusted under 35 U.S.C. 154(b) by 0 days.

(21) Appl. No.: 10/867,555

(22) Filed: Jun. 14, 2004

(65) Prior Publication Data

US 2006/0010759 A1 Jan. 19, 2006

(51) Int. Cl.
*F41G 1/387* (2006.01)

(52) U.S. Cl. ..... 42/126

(58) Field of Classification Search ..... 42/124, 42/125, 126
See application file for complete search history.

(56) References Cited

U.S. PATENT DOCUMENTS

| | | | | |
|---|---|---|---|---|
| 465,088 | A | 12/1891 | Patchen | 42/125 |
| 1,834,637 | A * | 12/1931 | Pedersen | 42/137 |
| 2,155,391 | A | 4/1939 | Arden | 42/125 |
| 2,632,253 | A * | 3/1953 | Stith | 42/126 |
| 2,830,373 | A | 4/1958 | Dahlberg | 42/126 |
| 3,463,430 | A * | 8/1969 | Rubin et al. | 42/124 |
| 3,867,764 | A | 2/1975 | Dunmire et al. | 42/115 |
| 3,922,794 | A | 12/1975 | Ackerman et al. | 42/126 |
| 4,317,304 | A | 3/1982 | Bass | 42/125 |
| 4,660,289 | A | 4/1987 | Wilhide | 42/125 |
| 4,905,396 | A | 3/1990 | Bechtel | 42/127 |
| 4,959,908 | A * | 10/1990 | Weyrauch | 42/124 |
| 5,086,566 | A | 2/1992 | Klumpp | 42/126 |
| 5,400,539 | A | 3/1995 | Moore | 42/127 |
| 5,428,915 | A | 7/1995 | King | |
| 6,073,351 | A | 6/2000 | Barnett | |
| 8,418,657 | | 7/2002 | Brown | 42/124 |
| 6,508,144 | B1 * | 1/2003 | Vendetti et al. | 74/553 |
| 6,901,692 | B1 * | 6/2005 | Miller | 42/124 |
| 2004/0134057 | A1 * | 7/2004 | Samchisen | 29/426.5 |

FOREIGN PATENT DOCUMENTS

JP 2000-87461 * 3/2000

OTHER PUBLICATIONS

English Abstract of JP 2000-87461 (Mihashi KK).*

* cited by examiner

*Primary Examiner*—Stephen M. Johnson

(57) ABSTRACT

An adjustable scope mounting device for adjusting a scope mounted on a gun. The scope utilizes opposite threaded screws for elevational adjustment and further includes a windage adjustment.

6 Claims, 4 Drawing Sheets

EXTERNAL ADJUSTABLE TELESCOPIC SCOPE DEVICE

BACKGROUND OF THE INVENTION

1. Field of the Invention

The present invention relates to external adjustable telescopic scope devices. For various reasons it is necessary to make adjustments when firing a rifle. The present invention relates to adjustments made to telescopic scopes for firearms.

2. Description of the Prior Art

Telescopic scope devices are commonly used on firearms. Typically the scope devices have external adjustment only on the windage axis (left-right variation). When firing a firearm, minute adjustments can substantially impact the ability to target or sight a target since the target is often a substantial distance away and any small variations are magnified greatly.

U.S. Pat. No. 5,428,915 discloses using two bases for use in adjustment of a telescopic sight. Theses bases have spaced detents holes which provide for three positions of vertical adjustment. The front based holes are horizontally aligned and parallel with the bore. The rear based holes are angularly positioned relative to the bore. This angularity provides the elevation adjustment. The adjustment for elevation is made as follows: First the screws that secure the scope through the rings must be loosened sufficiently to allow for the sliding of the scope within the rings. The loosening of one clamp front or rear may be necessary. Secondly four ring to base screws must be loosened sufficiently to disengage screws from the detent holes. Thirdly the adjustment choices are rear (upper), center (center) or front (lower). The scope must be aligned with front based holes and rear based detents screws. The screws must be tightened securely.

It is an object of the current invention to simplify the ease of making both left to right and elevational adjustments. It is a further object of the present invention to minimize any error that can be incurred in adjusting the scope device.

SUMMARY OF THE INVENTION

The external adjustable telescopic scope device is a unique device whose purpose is to adjust the horizontal and vertical plane (windage and elevation) sight settings of a firearm mounted telescopic sight (scope) independent of the scope's internal adjusting mechanisms. Elevation adjustments are accomplished by utilizing left and right hand threaded thumb wheel. The dual threaded thumb wheel insures full control of movement regardless of direction. This, in turn, makes any and all adjustments absolutely repeatable with a rigid lockup and no reliance on spring tension. A mechanical windage adjustment system is incorporated. Sight settings are identified by stamped indicators at the top of the thumb wheel for each increment of adjustment. Elevation adjustment settings are secured by a pin which locks into the corresponding groove onto the outer edge of the dual threaded thumb wheel. Installation is ingeniously simple. The device affixes directly to the firearm using the industry standard scope mounting holes which are drilled and tapped at the factory. Therefore, it is compatible with almost every commercially produced gun designed for use with a scope.

The specifics of the present invention are that there is a mounting means for mounting the device on the gun having the first receiving means for receiving a threaded screw. The threaded screw is the bottom right-hand threaded screw that is screwed into a right-hand threaded aperture within the mounting means. The mounting means preferably has a top and bottom piece with the bottom piece as a standard mounting base for the gun and the top piece is mounted on top of the standard base and also on top of the means for windage adjustment, which is a screw adjustment suitable for moving the scope in either direction horizontally. The top piece preferably includes a pin, spring and screw and a bore or aperture within said top piece wherein the pin fits on top of the top piece. Preferably on top of the top piece is an adjusting wheel, which is rigidly connected to the top and bottom threaded screws and has an outside perimeter, having indents on the outside perimeter. The pin then is preferably in direct contact with the indents of the outer perimeter of the wheel. The screw can adjust the tension on the spring, which allows the pin to move from detent to detent on the wheel. The top and bottom threaded screws must be configured in the opposite direction of each other and the bottom threaded screw is screwed into the first receiving means. The top threaded screw is screwed into a second receiving means. The second receiving means is within a connecting means for connecting the device to a scope. Typically, the second receiving means would be within the scope ring.

DESCRIPTION OF THE PREFERRED EMBODIMENT

Figure 1:
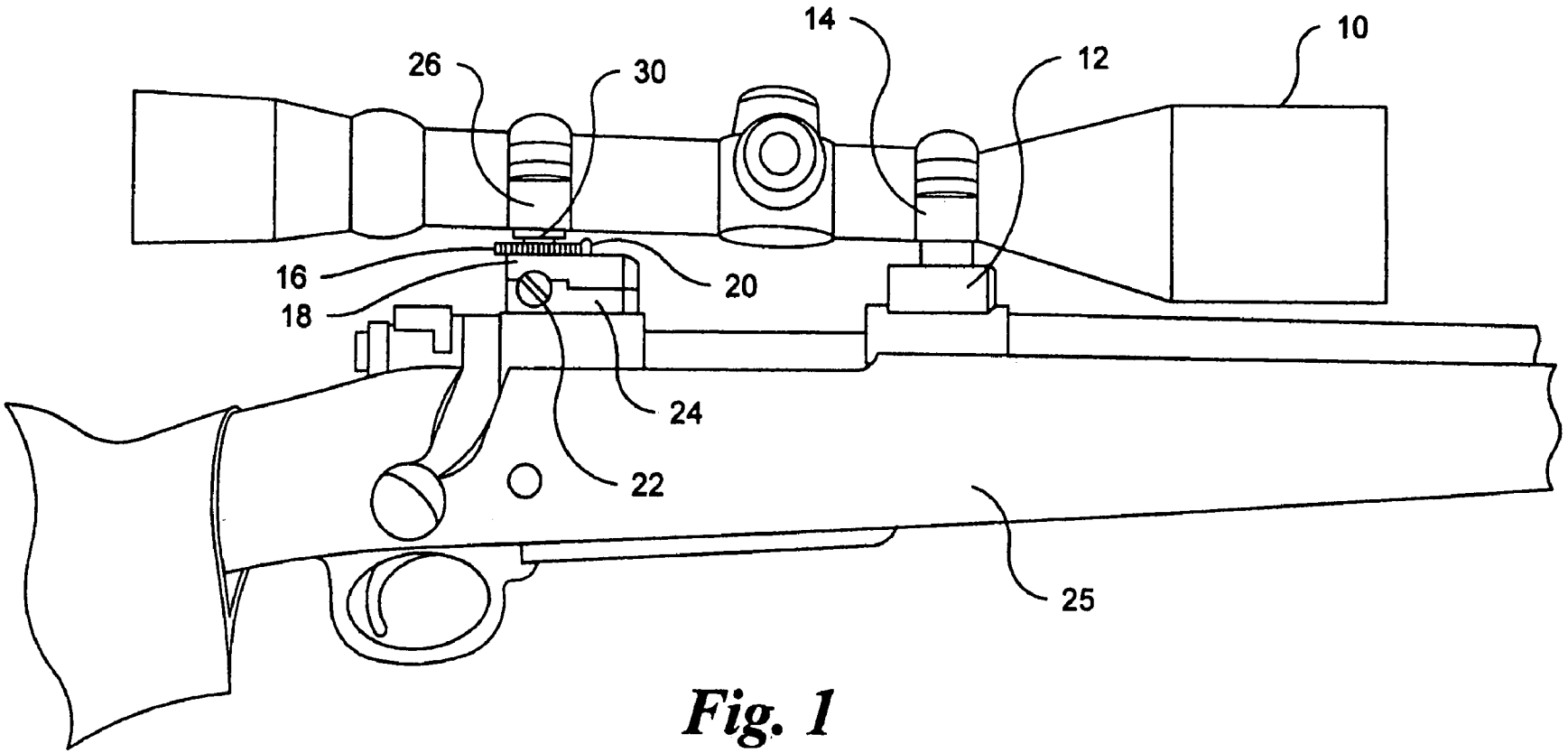
FIG. 1 is a right side elevational view of the adjustable scope-mounting device, mounted on a rifle.

The purpose of the external adjusting telescopic sight device is to adjust the horizontal and vertical plane (windage and elevation) site settings of a firearm mounted for a telescopic sight (scope), independent of the internal adjustment mechanisms of the scope. FIG. 1 shows the scope 10 mounted on the external adjustable telescopic sight device which, in turn, is mounted on the rifle 25. The scope 10 is mounted to the rifle 25 at two different locations. On the front location, the scope 10 is mounted to the front scope ring 14 which sits on the front scope-mounting base 12, which, in turn, is mounted on the rifle 25.

In the rear location, the rear scope ring 26 is mounted to the left-hand threaded screw 30. The right-hand thread screw 32 (shown in FIG. 3 but not shown in FIG. 1) is screwed into the wheel body 18. The left-hand threaded screw 30, the right-hand threaded screw 32 and the adjusting wheel 16 are preferably all one piece. The wheel body 18 is mounted on the rear base 24 which, in turn, is mounted on the rifle 25. The windage adjusting screw 22 is mounted on the rear base 24 and adjusts the scope to the left or to the right to compensate for crosswinds and horizontal adjustments.

Figure 2:
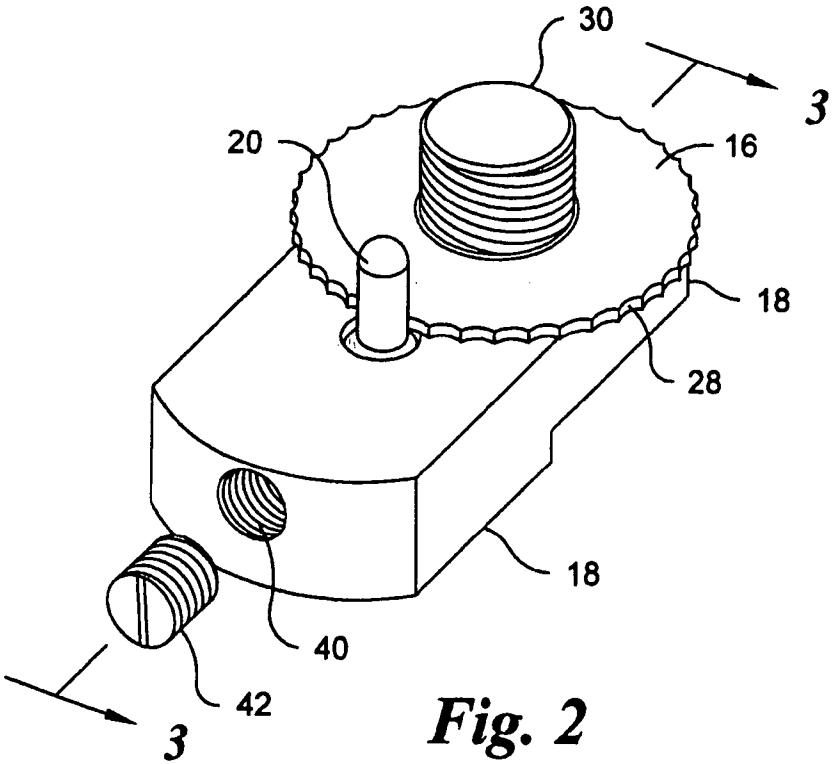
FIG. 2 is a top view of the wheel, pin and top piece of the base connecting means.

FIG. 2 is a top view of the wheel, pin and top piece of the base connecting means. In the preferred embodiment of the device, the adjusting wheel 16, has adjusting wheel detents 28, which are contacted by the pin 20. The number of detents and the size of the pin can be determined to regulate the effect of each click on the pin 20 so as to regulate the height of the adjustment. As shown in FIG. 2, each detent would represent a vertical adjustment of 0.00125 inches. The wheel body 18 has within it an aperture 40 of sufficient diameter to fit the pin locking screw 42, the details of which are shown in FIG. 3.

Figure 3:
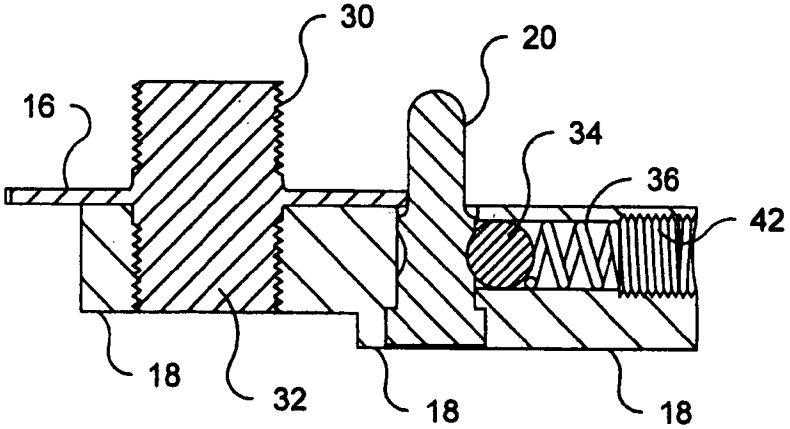
FIG. 3 is a cross-sectional, right-sided view of the threaded screw and pin and spring.

In FIG. 3, the left-hand threaded screw 30 and the right-hand threaded screw 32, along with the adjusting wheel 16 are shown as one solid piece. The right-hand threaded screw is screwed into the wheel body 18 and the adjusting wheel 16 is in contact with the pin 20. The amount of tension placed on the adjusting wheel 16 by the pin 20 at the adjusting wheel indents 28 (as shown in FIG. 2) is regulated by the combination of the ball 34, spring 36 and pin locking screw 42 by turning the pin locking screw 42, the amount of tension exerted on the spring 36 pushes the ball 34 to tighten or loosen the amount of pressure exerted by the pin 20 on the adjusting wheel 16 and when the desired adjustment is set the pin locking screw 42 is tightened to lock in the adjustment.

Figure 4:
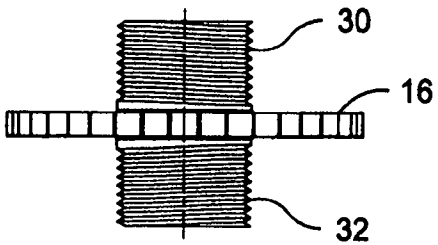
FIG. 4 is a cross-sectional view showing the top and bottom threaded screw configured in the opposite direction of each other.

FIG. 4 is a cross-sectional view showing the top and bottom threaded screw, configured in the opposite direction of each other. The top screw 30 is a left-hand threaded screw and the bottom screw 32 is a right-hand threaded screw. Separating the top screw 30 from the bottom screw 32 is the adjusting wheel 16. The piece shown in FIG. 4 is preferably made from one continuous piece of metal and the screws are preferably a left hand threaded screw designated as 0.375 inches diameter having 40 threads per inch Unified National Special Class 2A and a right hand threaded screw designated as 0.375 inches diameter having 40 threads per inch Unified National Special Class 2A. This allows for the very fine adjustments to the scope. Note that by utilizing a left-hand threaded screw and a right-hand threaded screw, the error in adjustment is eliminated. Each click of the adjusting wheel 16 on the pin 20 shown in FIG. 1 represents an adjustment in both directions. Total adjustment by each click of the adjusting wheel 16 represents an adjustment of 0.00125 inches.

Figure 5:
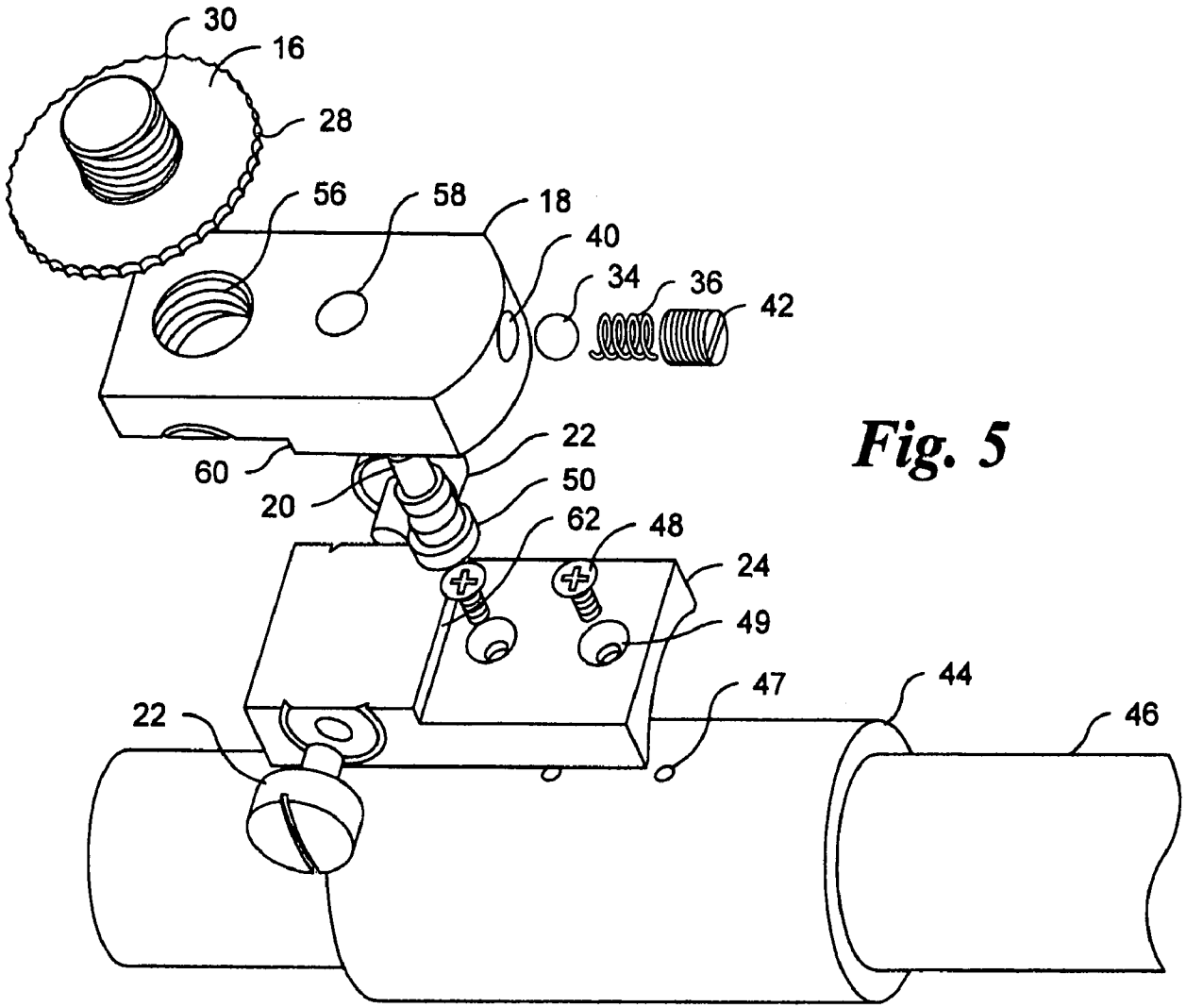
FIG. 5 is an exploded view of the external adjustable scope device.

FIG. 5 is an exploded view of the external adjustable scope device. The action housing 44 allows for the external adjustable telescopic scope device to be securely mounted onto the rifle. The action housing 44, which covers the rifle barrel 46, has two threaded apertures for receiving screws 48 which pass through aperture 49 in the rear base 24 and securely attach said rear base to the rifle 25 as shown in FIG. 1. The windage adjustment screws 22 are also shown connected to the rear base 24. Next the wheel body 18 is set onto the rear base 24 and screwed in place by tightening the windage adjustment screws 22. The means for mounting to the rifle includes a top piece, the wheel body 18, and a bottom piece, the rear base 24. The rear base 18 is designed to fit over the rear base 24. The wheel body 18 has a front portion which is to the front of edge 60 as shown in FIG. 5 that extends down further than the rear portion, which is rear of edge 60 and together is "L" shaped. The rear base has a front portion in front of edge 62 that rises less than the rear portion rear of edge 62 also forming an "L" shape when the top piece, wheel body 18 is set on the rear base 24, edges 60 and 62 meet forming a snug fit between the two pieces. The wheel body 18 has three apertures, the right-hand threaded aperture, or first receiving means 56, the pin body aperture 58 and the pin locking screw-threaded aperture 40 as shown in FIG. 5. The pin body 50 sits in the pin body aperture 58 and the pin 20 extends through the top of the pin body aperture 58. The pin body aperture 58 is elongated allowing the pin 20 to move back and forth towards and away from the adjusting wheel 16 and not side to side. The ball 34, and spring 36 are locked into the screw-threaded aperture 40 by the pin locking screw 42. The pin locking screw 42 can be adjusted so that the give on the pin 20 when pressed against the adjusted wheel detents 28 can be adjusted. The right-hand threaded screw 32, not shown in FIG. 5, but shown in FIG. 3, is screwed into the right-hand threaded aperture 56, thereby attaching the adjusting wheel 16 and left-hand threaded screw 30 to the wheel body 18. The rear scope ring shown in FIG. 1 has a left-hand threaded screw aperture similar but opposite to the right-hand threaded aperture 56 shown in FIG. 5. The left-hand threaded screw is screwed into the left-hand threaded aperture of where scope ring 26 shown in FIG. 1. The front scope ring 14 is securely attached to the front scope-mounting base 12.

Figure 6:
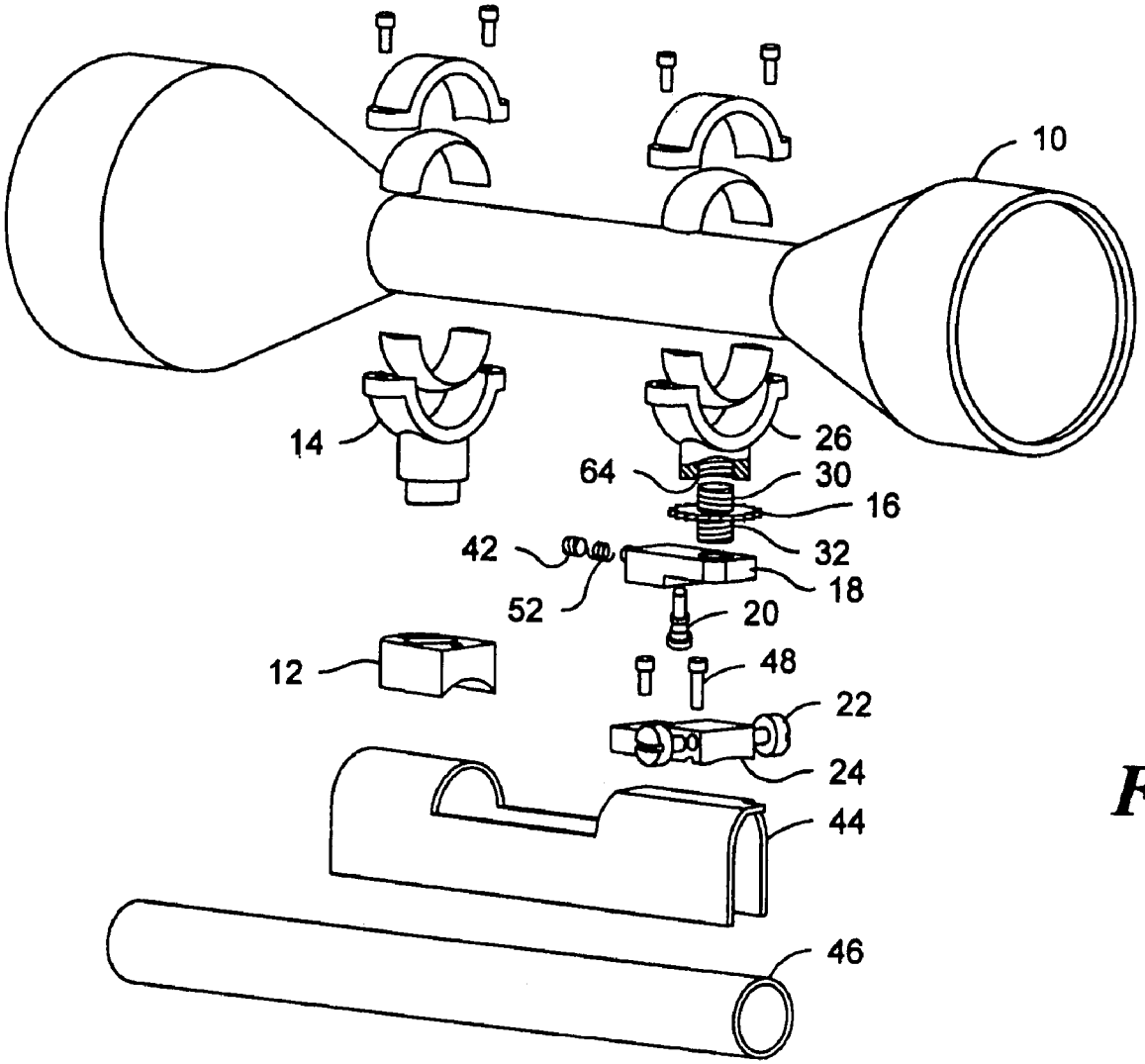
FIG. 6 is a left-sided exploded view of the external adjustable scope device attaching the scope to a rifle.

FIG. 6 is a left-sided exploded view of the external adjustable scope device which shows its attachment to the scope and its attachment to the rifle. The scope 10 is shown attached to the front scope ring 14 and the rear scope ring 26. The scope rings are standard scope rings utilized to attach scopes to rifles. The rear scope ring 26 is also shown with the left hand threaded aperture or second receiving means 64 which is threaded so that it can receive the left hand threaded screw 30. The right hand threaded screw 32 is screwed into the right hand threaded aperture or first receiving means 56 as shown in FIG. 5. The remainder of the external adjustable scope device is as shown in FIG. 5, except that the action housing 44 is shown in more complete detail as would typically be shown attached to the rifle barrel 46.

The invention claimed is:

1. An adjustable scope mounting device for adjusting a scope mounted on a gun, comprising:

(a) a mounting means for mounting said device to said gun having a first receiving means for receiving a threaded screw;

(b) a connecting means for connecting said device to said scope having a second receiving means for receiving a threaded screw, said first and second receiving means configured to receive screws threaded in the opposite direction of each other;

(c) a member having a top and bottom threaded screw wherein the top and bottom screws are configured in the opposite direction of each other and said top threaded screw screwed into said second receiving means and said bottom threaded screw screwed into said first receiving means;

(d) an adjusting means for rotating said threaded screws into said receiving means.

2. The adjustable scope-mounting device of claim 1 further including a second scope mounting means connecting said scope to said gun.

3. The adjustable scope mounting device of claim 1, wherein said adjusting means is rigidly connected to said member as a wheel rigidly connected to both top and bottom threaded screws and having an outside perimeter having indents on the outside perimeter.

4. The adjustable scope-mounting device of claim 1 further comprising a means for windage adjustment, for moving said scope in either direction horizontally, attached to said mounting means.

5. The adjustable scope mounting device of claim 1, wherein the mounting means is a base having a top and bottom piece wherein said bottom piece is a mounting base for said gun and said top piece is mounted on top of said mounting base and said means for windage adjustment includes two screws screwed into said bottom piece and secure said top piece to said bottom piece.

6. The adjustable scope mounting device of claim 5, wherein said top piece includes a pin, spring, and screw and a bore within said top piece, wherein said adjusting means is rigidly connected to said member as a wheel rigidly connected to both top and bottom threaded screws, having an outside perimeter having indents on the outside perimeter, wherein said pin sits on top of said top piece is in direct contact with the indents of the outer perimeter of said wheel and further wherein said spring is located within said bore of said top piece further including said screw for adjusting the tension on said spring which controls said pin's from indent to indent on said wheel.

* * * * *